US007322789B2

(12) United States Patent
Burdgick

(10) Patent No.: US 7,322,789 B2
(45) Date of Patent: Jan. 29, 2008

(54) METHODS AND APPARATUS FOR CHANNELING STEAM FLOW TO TURBINES

(75) Inventor: Steven Sebastian Burdgick, Guilderland, NY (US)

(73) Assignee: General Electric Company, Schenectady, NY (US)

( * ) Notice: Subject to any disclaimer, the term of this patent is extended or adjusted under 35 U.S.C. 154(b) by 145 days.

(21) Appl. No.: 11/268,149

(22) Filed: Nov. 7, 2005

(65) Prior Publication Data

US 2007/0104572 A1 May 10, 2007

(51) Int. Cl.
*F01D 1/02* (2006.01)

(52) U.S. Cl. ..... 415/103; 415/115; 416/96 R; 416/97 R

(58) Field of Classification Search ..... 415/100, 415/102, 103, 115, 178, 180; 416/97 R
See application file for complete search history.

(56) References Cited

U.S. PATENT DOCUMENTS 1,273,633 A * 7/1918 Ljungstrom ..... 415/62
3,880,549 A * 4/1975 Schrieken ..... 415/95
3,915,588 A * 10/1975 Brandstatter ..... 415/100
4,029,432 A * 6/1977 Meylan et al. ..... 415/101
4,571,153 A 2/1986 Keller
4,634,340 A * 1/1987 Stetter ..... 415/95
5,024,579 A 6/1991 Groenendaal, Jr. et al.
5,174,120 A 12/1992 Silvestri, Jr.
5,249,918 A 10/1993 Knorowski
5,295,301 A 3/1994 Knorowski
5,593,273 A 1/1997 Brinkman
6,048,169 A * 4/2000 Feldmuller et al. ..... 415/115
6,082,962 A * 7/2000 Drosdziok et al. ..... 415/115
6,102,654 A 8/2000 Oeynhausen et al.
2006/0269397 A1 11/2006 Burdgick et al.

* cited by examiner

*Primary Examiner*—Igor Kershteyn
(74) *Attorney, Agent, or Firm*—Armstrong Teasdale LLP

(57) ABSTRACT

Method and apparatus for assembling a double flow steam turbine is provided. The method comprises providing an annular member having a first end, a second end, and a body extending therebetween, coupling a first arcuate member to the annular member wherein the first member includes a radially inner surface that defines an inner diameter of the first member and an opposite radially outer surface that defines an outer diameter of the first member, wherein the inner surface is substantially parallel to the outer surface, and coupling a second arcuate member to the annular member wherein the second member includes a radially inner surface that defines an inner diameter of the second member and an opposite radially outer surface that defines an outer diameter of the second member. The method also comprises coupling the second member to the first member such that a steam turbine flow splitter is formed.

20 Claims, 3 Drawing Sheets

METHODS AND APPARATUS FOR CHANNELING STEAM FLOW TO TURBINES

BACKGROUND OF THE INVENTION

This invention relates generally to steam turbines, and more particularly, to cooling a first stage of a double flow turbine.

At least some known steam turbines include a turbine configuration wherein steam flow entering the turbine assembly is split into two opposite directions using a flow splitter or a tub. In such a configuration, steam contacting the splitter is channeled through opposing turbine nozzle and bucket stages positioned generally in a mirrored relationship on each side of the flow splitter.

Known splitters are fabricated from robust forgings or rings that are coupled together to form the splitter. To withstand the loading that may be induced from the steam flow, generally the forgings are massive structures that are typically coupled together during the final fabrication stage of the steam turbine. More specifically, the splitter halves are coupled together with a plurality of bolts that extend through openings defined in the flanges. The bolts are secured in position with a plurality of locking plates and nuts. During operation, because known splitters are coupled to the turbine portions, and thus rotate with the turbine portions, the bolted connections generate windage losses as the nuts, bolts, and locking plates create turbulence during rotation. Such windage losses adversely affect steam turbine performance and efficiency. In addition, such flow splitter are generally expensive to fabricate because of the amount of material used in fabricating such flow splitters and their associated bolted connections.

BRIEF DESCRIPTION OF THE INVENTION

In one aspect, a method for assembling a double flow steam turbine is provided. The method comprises providing an annular member having a first end, a second end, and a body extending therebetween, coupling a first arcuate member to the annular member wherein the first arcuate member includes a radially inner surface that defines an inner diameter of the first arcuate member and an opposite radially outer surface that defines an outer diameter of the first arcuate member, wherein the radially inner surface is substantially parallel to the radially outer surface, and coupling a second arcuate member to the annular member wherein the second arcuate member includes a radially inner surface that defines an inner diameter of the second arcuate member and an opposite radially outer surface that defines an outer diameter of the first arcuate member. The method also comprises coupling the second arcuate member to the first arcuate member such that a flow splitter is formed for use in the steam turbine.

In another aspect, a flow splitter for a double flow steam turbine including a first turbine portion and a second turbine portion is provided. The flow splitter includes an annular member, a first arcuate member, and a second arcuate member. The annular member includes a first end, a second end, and a body extending therebetween. The first arcuate member is coupled to the annular member, and includes a radially inner surface that defines an inner diameter of the first arcuate member and a radially outer surface that defines an outer diameter of the first arcuate member. The radially inner surface is substantially parallel to the radially outer surface. The second arcuate member is coupled to at least one of the first arcuate member and the annular member. The second arcuate member comprises a radially inner surface that defines an inner diameter of the second arcuate member and an opposite radially outer surface that defines an outer diameter of the first arcuate member.

In a further aspect, a double flow steam turbine is provided. The steam turbine includes a first turbine portion, a second turbine portion, and a flow splitter coupled between the first and second turbine portions for channeling steam flow into the first and second turbine portions. The flow splitter includes an annular member, a first arcuate member, and a second arcuate member. The first and second arcuate members are coupled together. The first arcuate member includes a substantially parallel radially inner surface and radially outer surface. The second arcuate member comprises a radially inner surface and an opposite radially outer surface. The second arcuate member is coupled to the first arcuate member and the annular member.

DETAILED DESCRIPTION OF THE INVENTION

Figure 1:
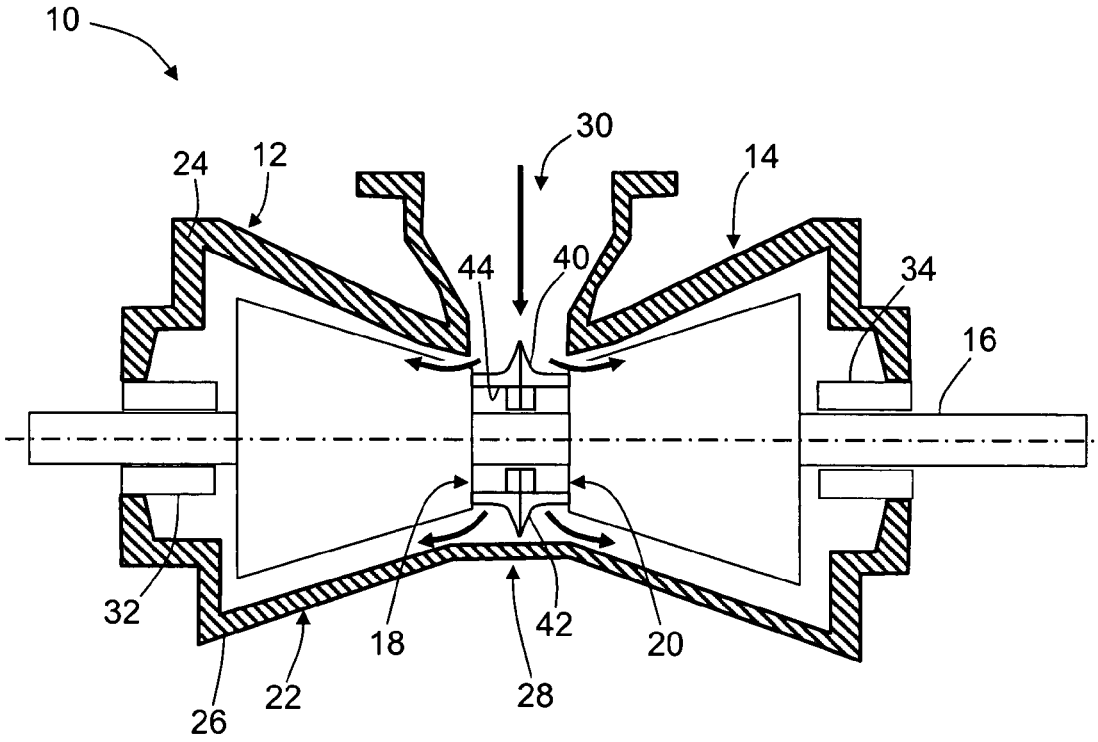
FIG. 1 is a schematic illustration of an exemplary known opposed flow, or double flow, steam turbine.

FIG. 1 is a schematic illustration of an exemplary known opposed-flow steam turbine 10. Turbine 10 includes first and second low pressure (LP) sections 12 and 14. A rotor shaft 16 extends through sections 12 and 14. Each LP section 12 and 14 includes a nozzle 18 and 20. A single outer shell or casing 22 is divided axially into upper and lower half sections 24 and 26, respectively, and spans both LP sections 12 and 14. A central section 28 of shell 22 includes a high pressure steam inlet 30. Within outer shell or casing 22, LP sections 12 and 14 are arranged in a single bearing span supported by journal bearings 32 and 34. It should be noted that although FIG. 1 illustrates a double flow low pressure turbine, as will be appreciated by one of ordinary skill in the art, the present invention is not limited to being used with low pressure turbines and can be used with any double flow turbine including, but not limited to intermediate pressure (IP) turbines or high pressure (HP) turbines.

A flow splitter 40 extends between first and second turbine sections 12 and 14. More specifically, flow splitter 40 includes a radailly outer surface 42 and an opposite radially inner surface 44. Radially outer surface 42 is arcuate and defines an apex 46 of flow splitter 40. Flow splitter 40 is substantially centered between turbine sections 12 and 14 such that apex 46 is substantially centered with respect to steam inlet 30.

During operation, low pressure steam inlet 30 receives low pressure/intermediate temperature steam 50 from a source, for example, an HP turbine or IP turbine through a cross-over pipe (not shown). The steam 50 is channeled through inlet 30 wherein flow splitter 40 splits the steam flow into two opposite flow paths 52 and 54. More specifically, the steam 50 is routed through LP sections 12 and 14 wherein work is extracted from the steam to rotate rotor shaft 16. The steam exits LP sections 12 and 14 and is routed, for example, to an intermediate pressure turbine (not shown).

Figure 2:
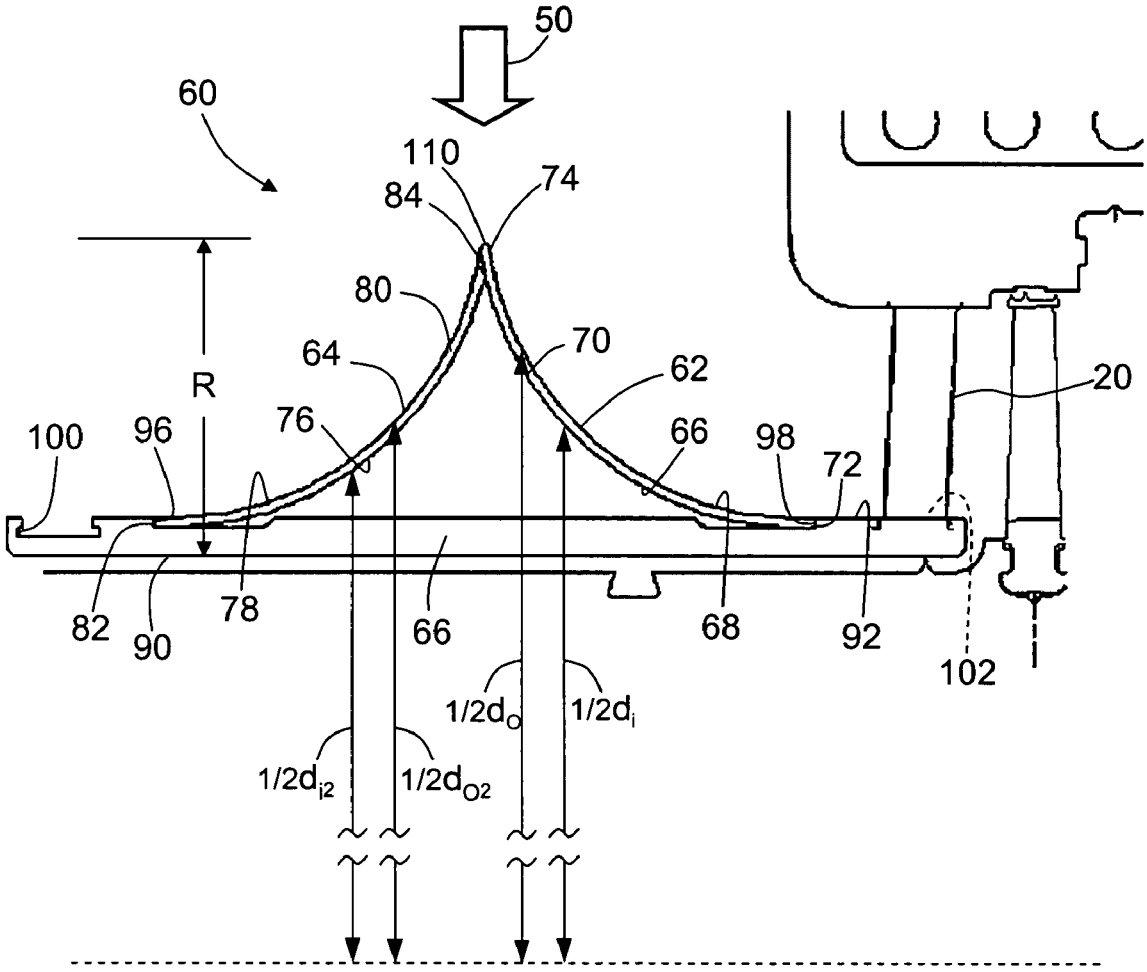
FIG. 2 is an enlarged schematic view of an exemplary flow splitter that may be used with the steam turbine shown in FIG. 1.

FIG. 2 is an enlarged schematic view of an exemplary flow splitter 60 that may be used with steam turbine 10. In the exemplary embodiment, flow splitter 60 includes a first flow member 62, a second flow member 64, and an annular member or barrel 66. In the exemplary embodiment, first flow member 62 and second flow member 64 are fabricated from a pair of arcuate shell members coupled together to extend circumferentially about rotor shaft 16 (shown in FIG. 1). In an alternative embodiment, flow members 62 and 64 are assembled from a plurality of arcuate shell members coupled together to form an assembly that extends circumferentially around shaft 16.

First flow member 62 includes a radially inner surface 66, an opposite radially outer surface 68, and a body 70 extending therebetween. In the exemplary embodiment, first member 62 is fabricated from thin formed plate or sheet metal, and more specifically, radially outer and inner surfaces 68 and 66, respectively, are substantially parallel to each other. For example, in one embodiment, body 70 may be fabricated from a sheet metal material having a thickness between approximately 0.25 to 0.375 inches. Radially inner surface 66 defines an inner diameter $d_i$ (measured with respect to a centerline (not shown) extending through steam turbine 10) for member 62 and radially outer surface 68 defines an outer diameter $d_o$ (measured with respect to the steam turbine centerline) for member 62. In the exemplary embodiment, body 70 is arcuate between an axially outer end 72 and an axially inner end 74. Accordingly, surfaces 68 and 66 are each arcuate such that both inner diameter $d_i$ and outer diameter $d_o$ are variable across body 70. In the exemplary embodiment, surfaces 68 and 66 are each formed with the same radius of curvature.

Second flow member 64 includes a radially inner surface 76, an opposite radially outer surface 78, and a body 80 extending therebetween. In the exemplary embodiment, second member 64 is substantially identical to first flow member 62 and is fabricated from sheet metal, and more specifically, radially outer and inner surfaces 78 and 76, respectively, are substantially parallel to each other. Radially inner surface 76 defines an inner diameter $d_{i2}$ (measured with respect to the steam turbine centerline) for member 64 and radially outer surface 78 defines an outer diameter $d_{o2}$ (measured with respect to the steam turbine centerline) for member 64. In the exemplary embodiment, body 80 is arcuate between an axially outer end 82 and an axially inner end 84. Accordingly, surfaces 78 and 76 are each arcuate such that both inner diameter $d_{i2}$ and outer diameter $d_{o2}$ are variable across body 80. In the exemplary embodiment, surfaces 78 and 76 are each formed with the same radius of curvature.

In the exemplary embodiment, annular member 66 is substantially cylindrical and extends circumferentially around shaft 16. In alternative embodiments, annular member 66 is from a pair of plurality of arcuate members coupled together to extend circumferentially around shaft 16. More specifically, annular member 66 includes a radially inner surface 90 and an opposite radially outer surface 92.

Outer surface 92 is formed with a pair of attachment channels 96 and 98, and a pair of nozzle channels 100 and 102 that each extend substantially circumferentially around annular member 66. Attachment channels 96 and 98 facilitate flow members 62 and 64 being coupled to annular member 66 without mechanical fasteners, and as described herein. Alternatively, annular member 66 may be formed with other means that facilitate flow members 62 and 64 being coupled to annular member 66. Nozzle channels 100 and 102 facilitate annular member 62 being coupled to turbine sections 12 and 14, as described herein. For example, in one embodiment, annular member 66 is welded to nozzles 18 (shown in FIG. 1) and 20 in a diaphragm construction. Alternatively, annular member 66 may be coupled to nozzles 18 and 20 using any means that enables flow splitter 60 to function as described herein, including, but not limited to, being coupled through a mechanical assembled joint in a drum/carrier construction.

In the exemplary embodiment, during assembly of splitter 60, initially first flow member 62 and second flow member 64 are coupled together and to annular member 66. More specifically, flow members 62 and 64 are coupled together adjacent radial inner ends 74 and 84, respectively, such that an apex 110 is defined for flow splitter 60. Apex 110 defines a radial height R for flow splitter 60 that is shorter than a radial height of at least some known flow splitters. In the exemplary embodiment, members 62 and 64 are welded together. Flow member radial outer ends 72 and 82 are then inserted within respective annular member attachment channels 96 and 98 and welded therein. In the exemplary embodiment, members 62 and 64 are welded together, and to annular member 66, using a low heat input type of weld. For example, in one embodiment, the limited depth welding process is accomplished through one of, but not limited to, a laser weld process, a flux-TIG weld process, or any other weld process used with butt type joints or other weld preparation joints and that facilitates reducing shrinkage and distortion during the weld process. In another embodiment, the welding process is accomplished through one of, but not limited to, a MIG weld or a braze joint.

Accordingly, a flow splitter 60 is formed that has enough strength in the axial direction to accommodate engine loading and enough strength in the radial direction to accommodate steam flow/pressure loading and/or thermal loading. Moreover, because the radial height R of splitter 60 is shorter in comparison to known flow splitters, splitter 60 is facilitated to have less thermal stresses than known flow splitters. Furthermore, because splitter 60 does not include the large flange and bolted connections of known splitters, windage losses and an overall weight of splitter 60 are facilitated to be reduced in comparison to known splitters. In addition, because splitter 60 does not include the large flange and bolted connections of known splitters, splitter 60 is more flexible than known splitters and a thermal gradient induced across the part, i.e., windage heating, is facilitated to be reduced in comparison to known splitters. The reduced thermal gradient facilitates improved sealing and less thermal distortion between the forward and aft faces of flow splitter 60 and a surrounding engine casing (not shown).

Figure 3:
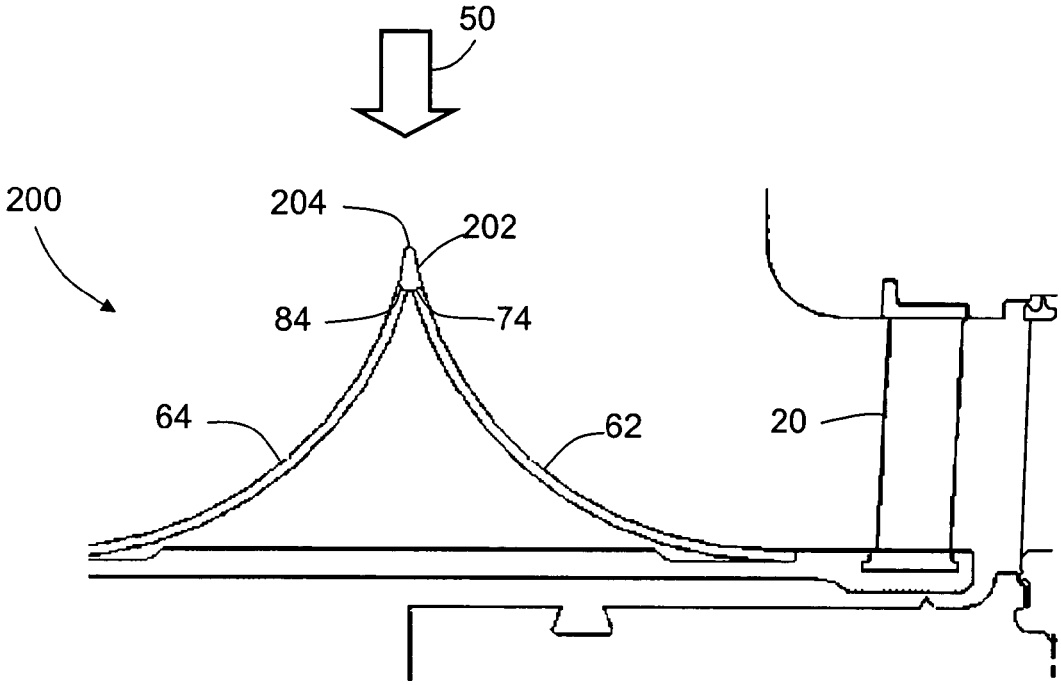
FIG. 3 is an enlarged schematic view of an alternative embodiment of a flow splitter that may be used with the steam turbine shown in FIG. 1.

FIG. 3 is a schematic view of an alternative embodiment of a portion of a flow splitter 200 that may be used with steam turbine 10. Flow splitter 200 is substantially similar to splitter 60 (shown in FIG. 2) and components in flow splitter 200 that are identical to components of splitter 60 are identified in FIG. 3 using the same reference numerals used in FIG. 2. More specifically, flow splitter 200 includes first flow member 62, second flow member 64, and annular member 66. In addition, flow splitter 200 includes an annular ring cap 202 that is coupled to flow member radial inner ends 74 and 84, respectively, to form an apex 204 for flow splitter 200. Ring cap 202 facilitates providing structural support to flow splitter 60 and facilitates positioning members 62 and 64 during welding.

Exemplary embodiments of flow splitters and steam turbines are described above in detail. Although the flow splitters are herein described and illustrated in association with the above-described steam turbine, it should be understood that the present invention may be used with any double flow steam turbine configuration. More specifically, the flow splitters are not limited to the specific embodiments described herein, but rather, aspects of each flow splitter may be utilized independently and separately from other turbines or flow splitters described herein.

While the invention has been described in terms of various specific embodiments, those skilled in the art will recognize that the invention can be practiced with modification within the spirit and scope of the claims.

What is claimed is:

1. A method for assembling a double flow steam turbine, said method comprising:

providing an annular member having a first end, a second end, and a body extending therebetween;

coupling a first arcuate member to the annular member wherein the first arcuate member includes a radially inner surface that defines an inner diameter of the first arcuate member and an opposite radially outer surface that defines an outer diameter of the first arcuate member, wherein the radially inner surface is substantially parallel to the radially outer surface;

coupling a second arcuate member to the annular member wherein the second arcuate member includes a radially inner surface that defines an inner diameter of the second arcuate member and an opposite radially outer surface that defines an outer diameter of the first arcuate member; and coupling the second arcuate member to the first arcuate member such that a flow splitter is formed for use in the steam turbine.

2. A method in accordance with claim 1 wherein coupling the second arcuate member to the first arcuate member comprises welding the second arcuate member to the first arcuate member.

3. A method in accordance with claim 1 wherein coupling the second arcuate member to the first arcuate member comprises coupling the second arcuate member to the first arcuate member such that an apex is defined along a centerline of the flow splitter.

4. A method in accordance with claim 1 further comprising coupling the first and second ends of the annular member to respective first and second turbine portions.

5. A method in accordance with claim 1 wherein coupling a first annular member to a first turbine portion further comprises:

coupling the first arcuate member to the second arcuate member without the use of mechanical fasteners; and coupling the first and second ends of the annular member to respective first and second turbine portions without the use of mechanical fasteners.

6. A flow splitter for a double flow steam turbine wherein the turbine includes a first turbine portion and a second turbine portion, said flow splitter comprises:

an annular member comprising a first end, a second end, and a body extending therebetween;

a first arcuate member coupled to said annular member, said first arcuate member comprising a radially inner surface that defines an inner diameter of said first arcuate member and an opposite radially outer surface that defines an outer diameter of said first arcuate member, said radially inner surface is substantially parallel to said radially outer surface; and a second arcuate member coupled to said first arcuate member and said annular member, said second arcuate member comprises a radially inner surface that defines an inner diameter of said second arcuate member and an opposite radially outer surface that defines an outer diameter of said second arcuate member, a nozzle connected to said annular member, said nozzle is spaced from said first and second arcuate members.

7. A flow splitter in accordance with claim 6 wherein at least one of said first arcuate member and said second arcuate member is welded to at least one of the first turbine portion and the second turbine portion.

8. A flow splitter in accordance with claim 6 wherein said first arcuate member is coupled to said second arcuate member such that an apex for said flow splitter is defined said apex is substantially centered with respect to said annular member.

9. A flow splitter in accordance with claim 6 wherein said first arcuate member outer and inner surfaces extend arcuately away from said annular member.

10. A flow splitter in accordance with claim 6 wherein said first arcuate member is coupled to said second arcuate member via one of a welding and a brazing operation.

11. A flow splitter in accordance with claim 6 wherein said first arcuate member and said second arcuate member are each fabricated from sheet metal.

12. A flow splitter in accordance with claim 6 wherein said flow splitter further comprises a centerline axis of symmetry, said flow splitter is substantially symmetric about said axis of symmetry when said first arcuate member is coupled to said second arcuate member.

13. A flow splitter in accordance with claim 12 further comprising an apex coupled to an intersection of said first arcuate member and said second arcuate member, said apex is substantially centered with respect to said axis of symmetry.

14. A double flow steam turbine comprising:

a first turbine portion;

a second turbine portion, and a flow splitter coupled between said first and second turbine portions for channeling steam flow into said first and second turbine portions, said flow splitter comprising an annular member, a first arcuate member, and a second arcuate member, said first arcuate member coupled to said annular member, said first arcuate member comprising a substantially parallel radially inner surface and radially outer surface, said second arcuate member comprises a radially inner surface and an opposite radially outer surface, said second arcuate member coupled to said first arcuate member and to said annular member a nozzle connected to said annular member, said nozzle is spaced from said first and second arcuate members.

15. A double flow steam turbine in accordance with claim 14 wherein said flow splitter first arcuate member is welded to said second arcuate member.

16. A double flow steam turbine in accordance with claim 14 wherein said annular member is coupled to said first turbine portion and said second turbine portion via one of a weld and a mechanical coupling.

17. A double flow steam turbine in accordance with claim 14 wherein said first arcuate member is coupled to said second arcuate member such that an apex is defined for said flow splitter.

18. A double flow steam turbine in accordance with claim 17 wherein said apex is substantially centered between said first turbine portion and said second turbine portion.

19. A double flow steam turbine in accordance with claim 14 wherein said first arcuate member is coupled to said second arcuate member, said flow splitter further comprises an apex coupled to an intersection of said first and second arcuate members.

20. A double flow steam turbine in accordance with claim 14 wherein said flow splitter facilitates reducing windage performance losses of said double flow steam turbine.

* * * * *